US005584675A

United States Patent [19]

Steurer et al.

[11] Patent Number: 5,584,675

[45] Date of Patent: Dec. 17, 1996

[54] CYLINDER SLEEVE FOR AN AIR COMPRESSOR

[75] Inventors: Brian M. Steurer; S. Shane Dexter, both of Jackson, Tenn.

[73] Assignee: Devilbiss Air Power Company, Jackson, Tenn.

[21] Appl. No.: 529,285

[22] Filed: Sep. 15, 1995

[51] Int. Cl.[6] ..... F04B 17/03

[52] U.S. Cl. ..... 417/372; 92/144

[58] Field of Search ..... 417/372, 415, 417/521; 92/144

[56] References Cited

U.S. PATENT DOCUMENTS

| | | | |
|---|---|---|---|
| 2,134,077 | 10/1938 | Ehret | 417/313 |
| 2,899,130 | 8/1959 | Sykes | 417/234 |
| 4,190,402 | 2/1980 | Meece et al. | 417/415 |
| 4,350,475 | 9/1982 | Meece et al. | 417/368 |
| 4,529,365 | 7/1985 | Schutt et al. | 417/313 |

*Primary Examiner*—Timothy Thorpe
*Assistant Examiner*—Peter G. Korytnyk
*Attorney, Agent, or Firm*—MacMillan, Sobanski & Todd

[57] ABSTRACT

An air compressor cylinder sleeve is formed from an extrusion having a central passage surrounded by a plurality of closed sided passages. Preferably, grooves are formed between adjacent ones of the closed sided passages. The extrusion is cut into individual cylinder sleeves which are mounted on compressor housings. The central passage receives a piston which is reciprocated by an eccentric on a motor shaft. The ends of the closed sided passages adjacent the housing open into the interior of the housing and the opposite ends of the passages open to atmosphere. A fan on the motor shaft causes air to flow through the compressor housing and through the closed sided passages to cool the cylinder sleeve.

6 Claims, 6 Drawing Sheets

CYLINDER SLEEVE FOR AN AIR COMPRESSOR

TECHNICAL FIELD

The invention relates to gas compressors and more particularly to a reciprocating piston oilless air compressor having an extruded air cooled cylinder sleeve.

BACKGROUND ART

In one type of air compressor, an electric motor rotates an eccentric which causes a piston to reciprocate in a cylinder. A valve plate closes an end of the cylinder and includes an inlet valve which allows air to be drawn into the cylinder from an inlet port during an intake stroke of the piston and an exhaust valve which allows compressed air to flow from the cylinder during a compression stroke of the piston. As the air is compressed, heat is released. The heat produced during compression can adversely affect the efficiency and operating life of the compressor.

In one type of air compressor, sometimes referred to as an oilless compressor, a thin piston is rigidly attached to a connecting rod. As the free end of the connecting rod is rotated by the eccentric the piston reciprocates in the cylinder and also rocks or tilts. A flexible seal extends around the perimeter of the piston to form a sliding seal as the piston reciprocates and rocks. The seal is formed from a material which does not require oil lubrication. Optionally, the interior wall of the cylinder may be coated with a low friction coating. Generally, the life of the sliding seal is the controlling factor in the service life of the compressor. One of the most significant factors in determining the operating life of the sliding seal is its maximum operating temperature. As the operating temperature of the seal increases, the life of the seal decreases. At higher operating temperatures, only a small temperature increase can significantly reduce the life of the piston seal. Consequently, it is important to design the compressor to maximize cooling of the cylinder walls and of the seal.

In prior art air compressors, a compressor was designed for a specific flow and compression capacity. Generally, the components of a compressor could not be adapted or used in a compressor having a different flow and compression capacity.

DISCLOSURE OF INVENTION

The invention is directed to a reciprocating piston air compressor having an extruded air cooled cylinder sleeve. The cylinder sleeve is extruded and cut into desired lengths based upon the piston displacement and the desired air pressure. The extruded cylinder sleeve is provided with closed sided, axially directed cooling air passages which are spaced around the exterior of the cylinder sleeve. Spaces or longitudinal grooves between the cooling air passages are provided for passing assembly bolts and for positioning the cylinder sleeve on a housing. The piston is reciprocated by an eccentric on the shaft of a motor. The eccentric is positioned on the motor shaft during assembly and is keyed to rotate with the shaft. A desired stroke of the piston can be set during manufacture by selection of the eccentric offset. Preferably, the eccentric includes an integral counterbalance weight which is sized based upon the mass of the piston. The cylinder sleeve is cut from the extrusion to a desired length based on the length of the piston stroke and the desired compression. The air flow rate and the compression of the compressor may be changed merely by selection of the eccentric and of the length of the cylinder sleeve, without changing any other compressor components.

The cylinder sleeve is positioned with its outer perimeter supported on the edges of an annular opening in a side of a housing. The cooling air passages extend radially inwardly from the perimeter of the cylinder sleeve. Ends of the cooling air passages open into the interior of the housing. A valve plate and a cylinder head are positioned over the opposite end of the cylinder sleeve and bolts are passed through openings in the cylinder head and engage the housing to clamp the cylinder sleeve and valve plate in place. Keys on the housing engage and position the cylinder sleeve on the housing, while permitting adjustment of the cylinder sleeve position in a direction parallel to the motor shaft. This adjustment accommodates accumulated tolerance variations in the assembled compressor components. In addition to the eccentric, a fan blade is mounted on the motor shaft to cause a flow of air into the housing. A portion of the air is exhausted through slots to cool the motor and a portion of the air is exhausted through the cooling air passages to cool the cylinder and edges of the valve plate and cylinder head. In addition, the cooling air flowing through the housing will cool the eccentric and the piston. By cooling the cylinder and the piston, the temperature of a sliding seal on the piston is reduced to increase the operating life of the seal.

If desired, a two cylinder air compressor may be constructed by mounting separate housings on opposite ends of the motor shaft so that each shaft end drives a separate piston and cooling fan. The inlets in the cylinder heads are connected together to a single inlet port and the outlets in the cylinder heads are connected together to a single outlet port.

Accordingly, it is an object of the invention to provide an improved construction for an oilless air compressor. Other objects and advantages of the invention will become apparent from the following detailed description of the invention and the accompanying drawings.

BEST MODE FOR CARRYING OUT THE INVENTION

Figure 1:
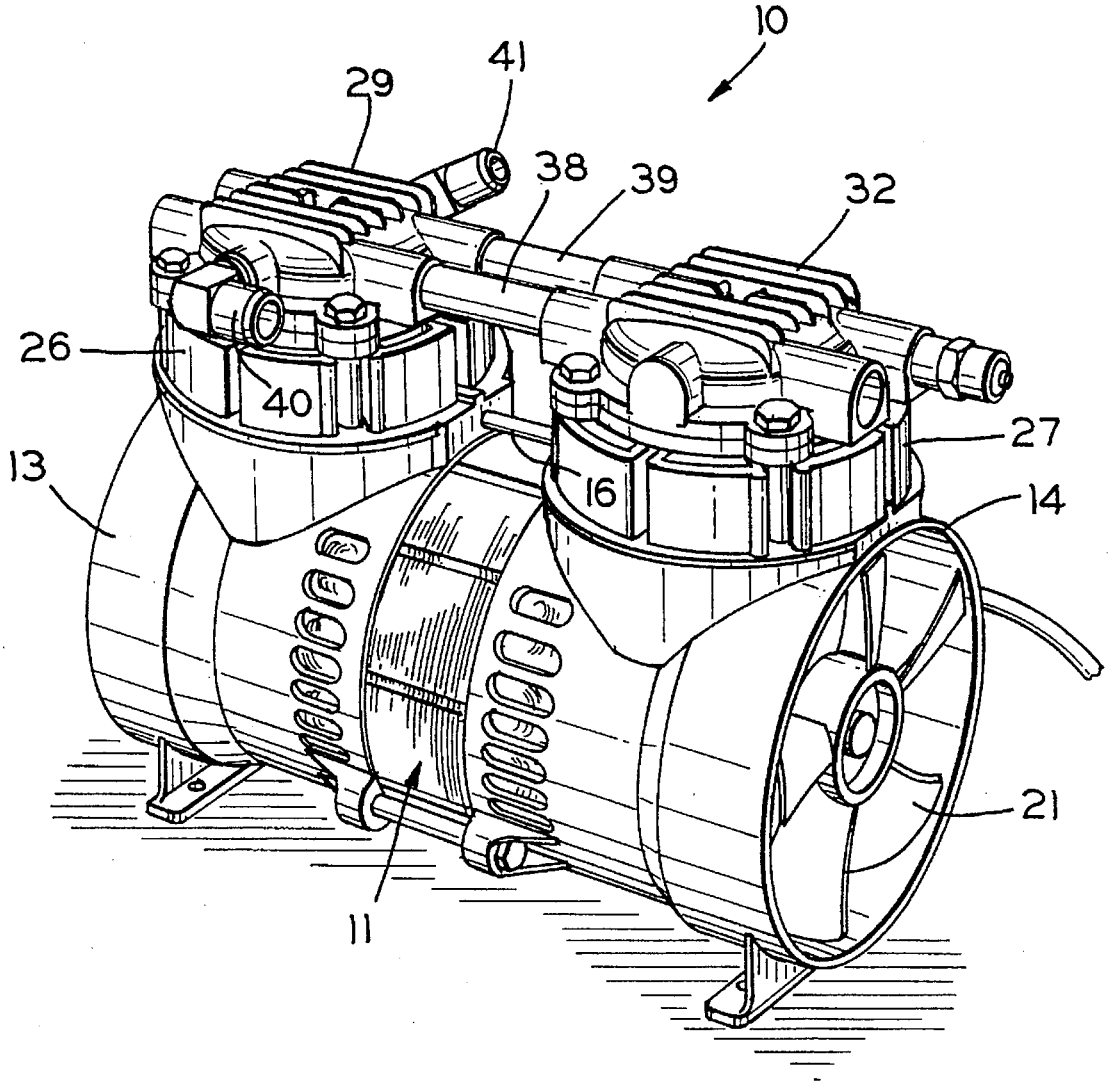
FIG. 1 is a perspective view of an air compressor constructed in accordance with a preferred embodiment of the invention.
Figure 2:
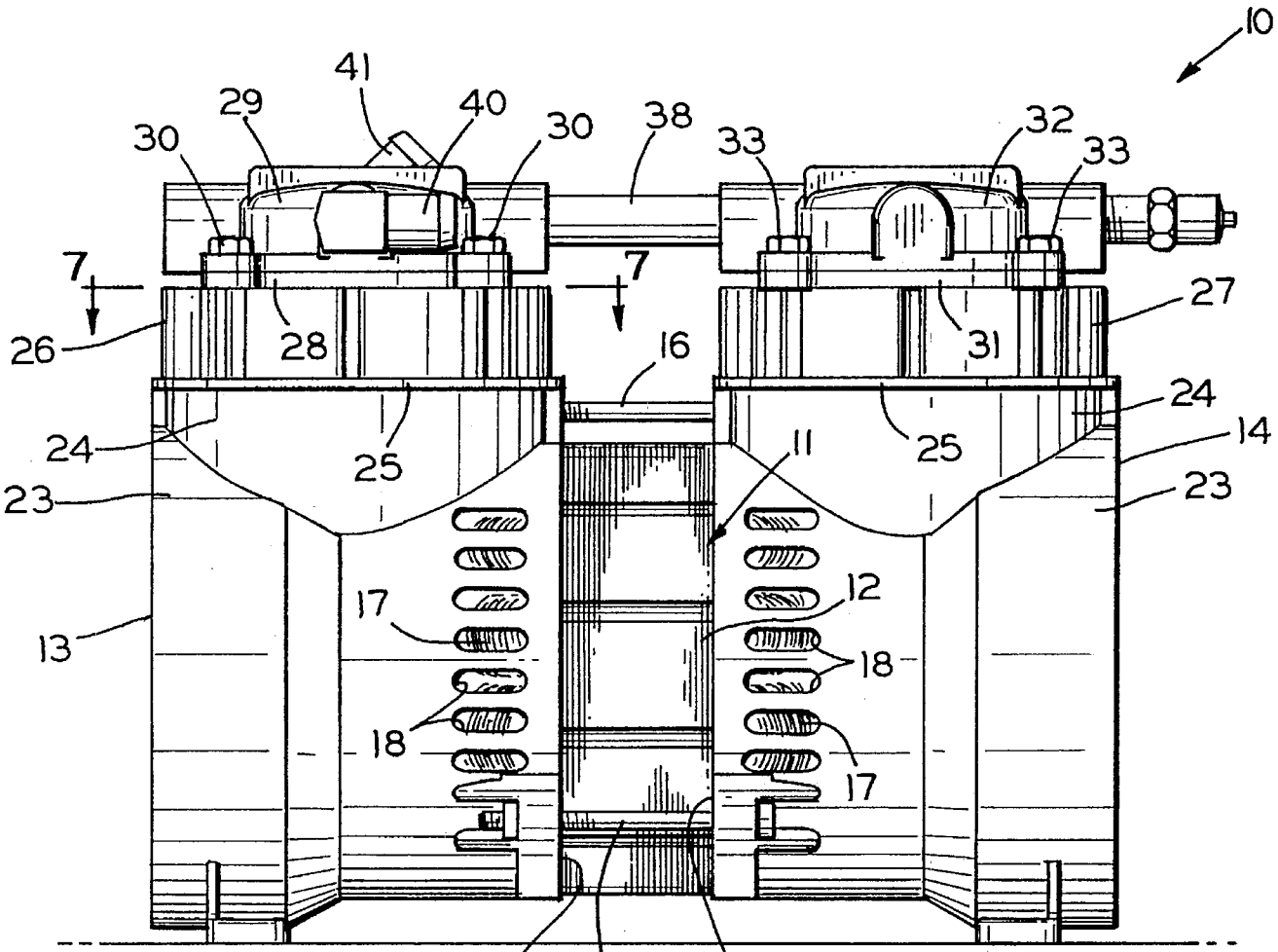
FIG. 2 is a side elevational view of the air compressor of FIG. 1.
Figure 3:
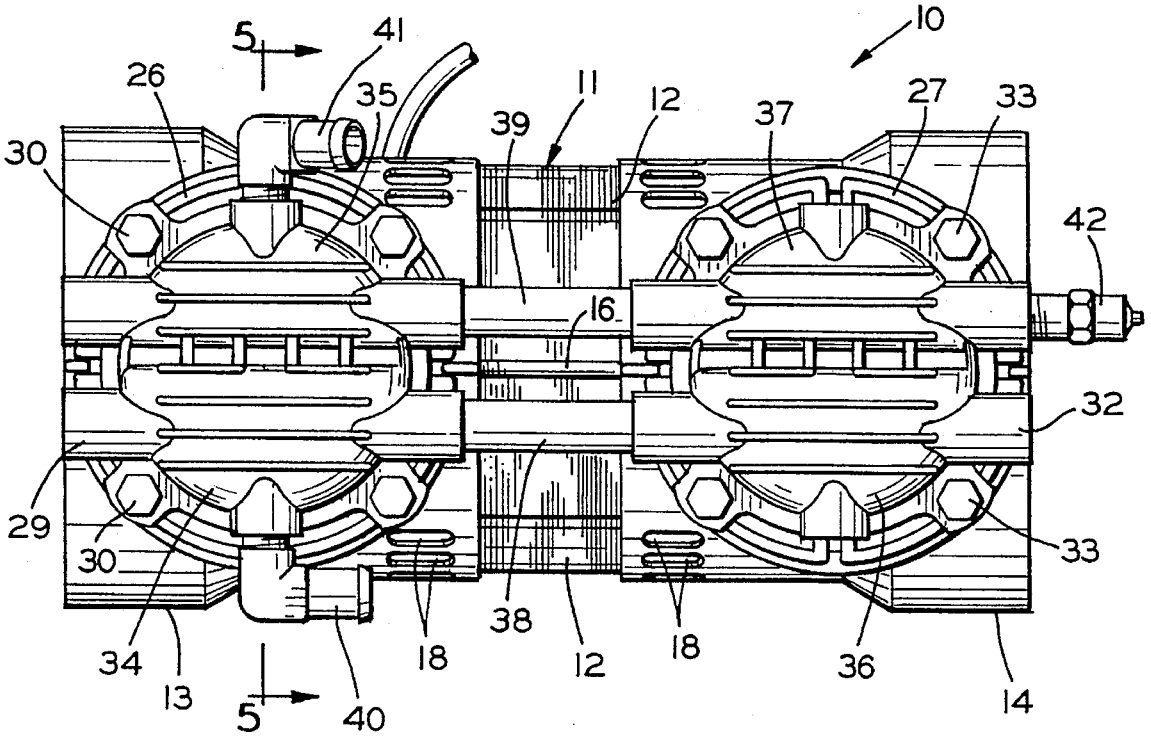
FIG. 3 is a top plan view of the air compressor of FIG. 1.

Referring to FIGS. 1–4 of the drawings, an oilless air compressor 10 is illustrated according to a preferred embodiment of the invention. The illustrated air compressor 10 is designed for use in a medical oxygen concentrator. However, other applications for the compressor 10 will be apparent to those skilled in the art. In order to achieve the design air flow and pressures, the compressor 10 has two cylinders, as will be described in detail below. It should be appreciated that the invention is equally applicable to a compressor having a single cylinder.

The air compressor 10 is operated by an electric motor 11 which has a stator 12. Housings 13 and 14 are positioned on opposite sides of the stator 12. The stator 12 is clamped between ends 15 of the housings 13 and 14 by a plurality of bolts 16 which extend between the housings 13 and 14. The stator 12 has a winding 17 which may extend into the housings 13 and 14. The housings 13 and 14 have cooling air vent slots 18 adjacent the stator winding 17. The motor 11 has a shaft 19 which extends into a hollow interior 20 of each of the housings 13 and 14. A fan 21 is mounted on a free end 22 of the shaft 19 in each of the housings 13 and 14. The fans 21 are designed to cause air to flow into the interior 20 of each housing 13 and 14 as the shaft 19 rotates. A portion of the air flow passes over and cools the stator winding 17 and is exhausted through the vent slots 18.

Each of the housings 13 and 14 has a generally cylindrical horizontal portion 23 and a generally cylindrical vertical portion 24. The vertical portion 24 has an annular upper edge 25. A cylinder sleeve 26 is positioned on the upper edge 25 of the housing 13 and a cylinder sleeve 27 is positioned on the upper edge 25 of the housing 14. A valve plate 28 and a cylinder head 29 are positioned on the cylinder sleeve 26. A plurality of bolts 30 extend through the cylinder head 29 and the valve plate 30 and engage the housing 13 to clamp the cylinder sleeve 26 to the housing 13. Similarly, a valve plate 31 and a cylinder head 32 are positioned on the cylinder sleeve 27 and are secured to the housing 14 with a plurality of bolts 33. The cylinder head 29 is separated into an inlet side 34 and an outlet side 35 which form separate air chambers and the cylinder head 32 is separated into an inlet side 36 and an outlet side 37 which form separate air chambers. A robe 38 extends between the inlet sides 34 and 36 to connect together the inlet chambers and a tube 39 extends between the outlet sides 35 and 37 to connect together the outlet chambers in the cylinder heads 29 and 32. An inlet port fitting 40 is connected to the inlet chamber in one of the cylinder heads 29 or 32 and an outlet port fitting 41 is connected to the outlet chamber in one of the cylinder heads 29 or 32. The inlet port 40 is connected to draw in ambient air, which preferably passes through one or more filters (not shown). The outlet port 41 delivers compressed air to, for example, a molecular sieve bed in an oxygen concentrator, or to any other compressed air consuming apparatus. Preferably, a high pressure relief valve 42 is attached to one of the cylinder heads 29 or 32 to connect with one of the compressed air outlet chambers.

Figure 5:
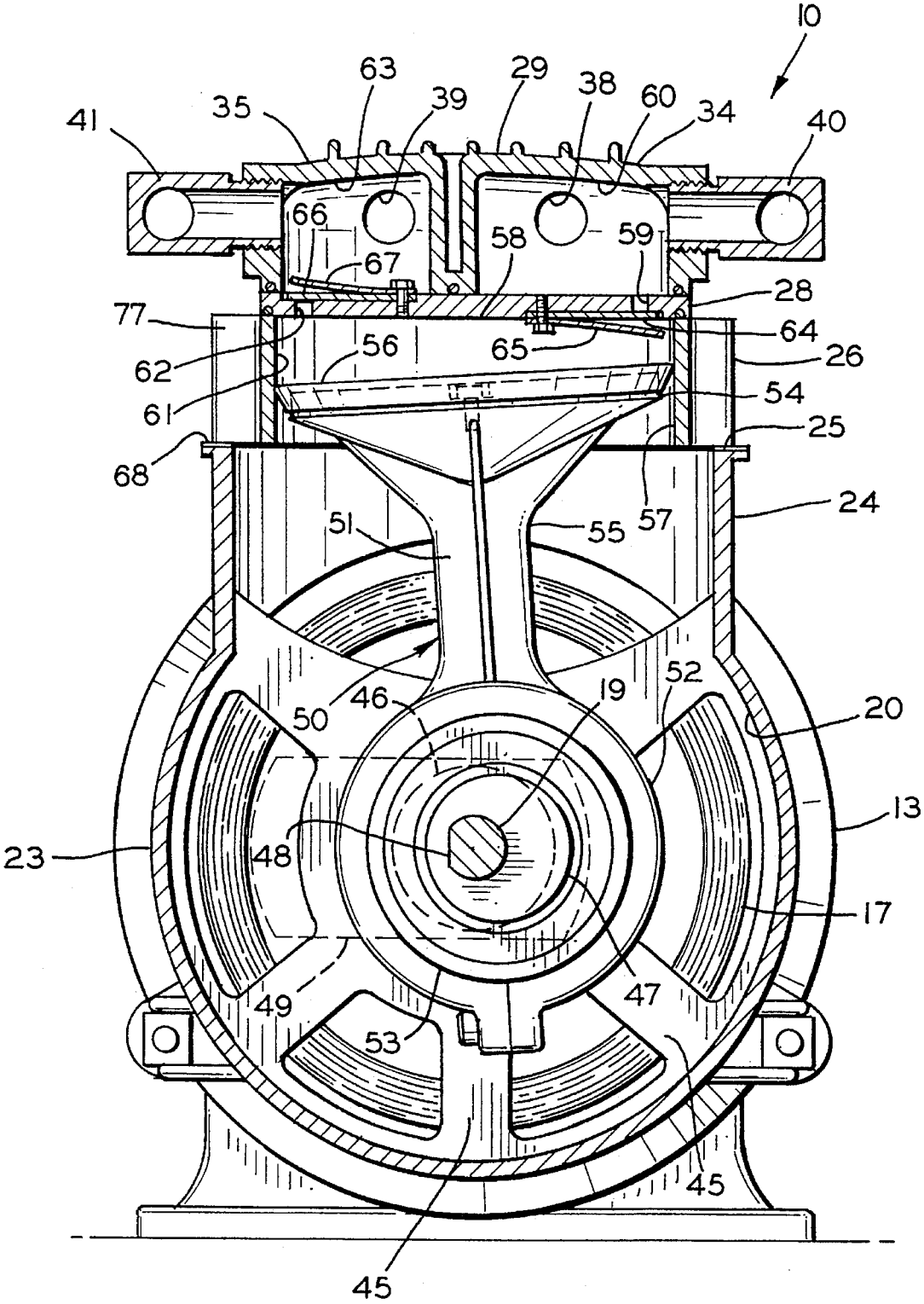
FIG. 5 is a cross sectional view as taken through line 5—5 of FIG. 3.

Referring now to FIG. 5, details are shown for the end of the compressor 10 at the housing 13. The housing 13 has a radially inwardly directed web 45 which mounts a bearing 46 for supporting the shall 19. An eccentric 47 is positioned on the shaft 19 next to the bearing 46. The eccentric 47 is prevented from rotating relative to the shaft 19 by a flat 48 on the shaft 19. Preferably, a balance weight 49 is formed integrally with the eccentric 47 to improve the dynamic balance of the compressor 10 as the shaft 19 rotates at high speeds. The eccentric 47 and the balance weight 49 may be secured to the shaft 19 with a set screw (not shown). A piston assembly 50 includes a connecting rod 51 which is attached at one end 52 through a bearing 53 to the eccentric 47. A piston head 54 is attached to an opposite end 55 of the connecting rod 51. A seal 56 extends around the perimeter of the piston head 54. Preferably, the seal 56 projects in a conical shape from the perimeter of the piston head 54 and is formed from a low friction flexible material, such as polytetrafluoroethylene. The seal 56 engages an interior cylindrical wall 57 in the cylinder sleeve 26. Since the piston head 54 and the connecting rod 51 are formed as an integral unit, the piston head 54 will rock or tilt as the piston head 54 reciprocates in the cylinder sleeve 26. The diameter of the piston head 54 must be slightly smaller than the diameter of the cylinder wall 57 to permit the piston head 54 to tilt or rock as it reciprocates. The seal 56 maintains an air tight seal with the cylinder wall 57 as the piston head 54 rocks and reciprocates.

The valve plate 28 abuts an upper end 58 of the cylinder sleeve 26 to close the cylinder 57. An intake port 59 extends from an inlet chamber 60 in the inlet side 34 of the cylinder head 29 through the valve plate 28 to an expansion chamber 61 formed by the piston head 54, the cylinder wall 57 and the valve plate 28. An exhaust port 62 extends from the expansion chamber 61 through the valve plate 28 to an outlet chamber 63 in the outlet side 35 of the cylinder head 29. A reed valve 64 and a valve stop 65 are secured to the valve plate 28 to allow air to be drawn from the chamber 60 through the port 59 into the expansion chamber 61 during the suction stroke of the piston 50. Similarly, a reed valve 66 and a valve stop 67 are secured to the valve plate 28 to allow air to be forced from the expansion chamber 61 to the outlet chamber 63 during the compression stroke of the piston 50.

It should be appreciated that the quantity of air delivered by the compressor 10 is a factor of the diameter of the cylinder wall 57 and the stroke of the reciprocating piston head 54. As the diameter of the cylinder wall 57 and/or the length of the reciprocation stroke of the piston head 54 increase, a greater amount of air will flow during each stroke of the piston head 54. The maximum pressure delivered by the compressor 10 is determined by the power of the motor and the dead air space between the piston head 54 and the valve plate 28 at the end of the compression stroke, or when the piston is at top dead center. The capacity of the compressor 10 is easily set during manufacture of the compressor 10 by selection of an eccentric 47 to give a desired piston stroke and by selecting the height of the cylinder sleeve 26. If desired, a choice of cylinder sleeves 26 having cylinder walls 57 of different diameters and pistons 50 having complementary diameter piston heads 54 also may be provided for selection during assembly of the compressor 10.

According to the invention, the cylinder sleeve 26 is an extrusion cut to a desired length. The length may be selected for a particular compressor design. If the compressor is used for an application which requires precision, the cylinder sleeves 26 and 27 are cut as closely as possible to the same length. One or more shims 68 may be inserted between each cylinder sleeve 26 and 27 and the annular housing edge 25 to balance the two cylinders for producing the same predetermined maximum compression during the compression strokes. The shims 68 may be used to compensate for accumulated tolerance variations in the assembled components of the compressor 10.

Figure 6:
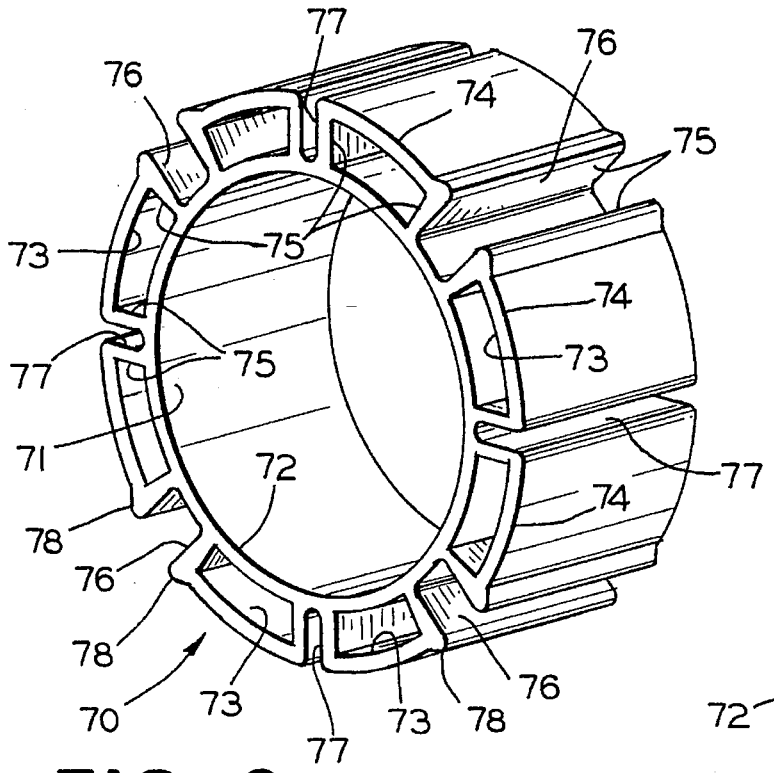
FIG. 6 is a fragmentary perspective view of an extrusion for a cylinder sleeve for the air compressor of FIG. 1.
Figure 8:
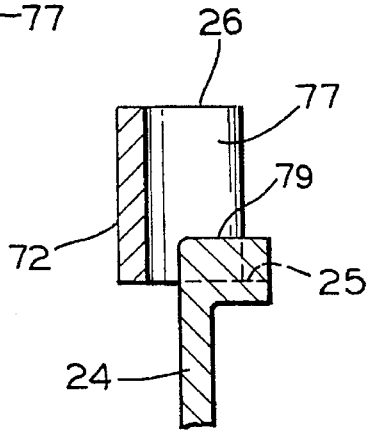
FIG. 8 is a fragmentary cross sectional view as taken along line 8—8 of FIG. 7.
Figure 7:
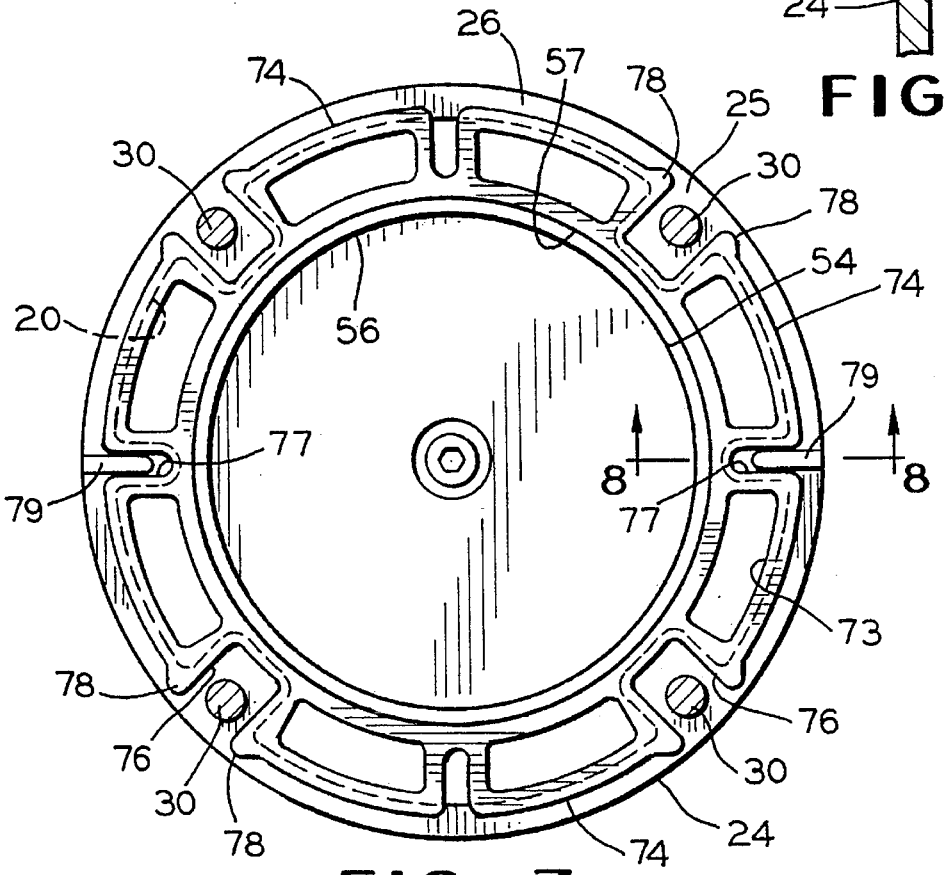
FIG. 7 is a cross sectional view as taken along line 7—7 of FIG. 2.

FIGS. 6 shows details of an extrusion 70 from which the cylinder sleeves 26 and 27 are cut. The extrusion 70 is formed to any desired length and preferably is of aluminum. The extrusion 70 has a smooth round central opening 71 defined by a cylindrical wall 72. A plurality of spaced passages 73 are formed around the exterior of the wall 72. In the illustrated preferred embodiment, eight passages 73 are spaced around the wall 72. The passages 73 are generally arcuate in shape and each have an arcuate inner side formed by the wall 72, an arcuate outer wall 74 and sides 75. The outer walls 74 form an outer perimeter to the extrusion 70. The sides 75 between adjacent passages 73 alternately form wide outwardly opening grooves 76 and narrow outwardly opening grooves 77. If eight passages 73 are formed in the extrusion, there will be four wide grooves 76 which are uniformly spaced 90° apart around the perimeter of the extrusion 70 and there will be four narrow grooves 77 which also are uniformly spaced 90° around the perimeter of the extrusion 70 between the grooves 76. Preferably, the sides 75 for each of the grooves 76 and 77 are parallel. The larger grooves 76 are sized sufficiently large to easily pass the bolts 30 and 33 which secure the cylinder sleeves 26 and 27 and the attached valve plates 28 and 31 and cylinder heads 29 and 32 to the housings 13 and 14, respectively. If necessary, the sides 75 of the wide grooves 76 may be lengthened and adjacent ends 78 of the sides 74 may thickened to prevent distortion from the compressive force of the bolts 30 and 33.

Referring to FIGS. 3, 4, 7 and 8, in assembling the compressor, it is desirable to accommodate tolerance variations in the direction of the axis of the shaft 19, while maintaining the position of the cylinder sleeves 26 and 27 in planes perpendicular to the shaft 19. Two raised bosses 79 extend from the annular upper edge 25 of the vertical portions 24 of each housing 13 and 14. The bosses 79 on each housing 13 and 14 are located on diametrically opposite sides of the upper edge 25 and extend in a plane through the axis of the shaft 19. The bosses 79 are sized to closely engage the sides 75 of the narrow slots 77 in the cylinder sleeves 26 and 27. The bosses 79 are spaced sufficiently apart to permit limited movement of the cylinder sleeves 26 and 27 on the annular upper housing edges 25 in a direction parallel to the axis of the shaft 19, while preventing movement in a direction perpendicular to the axis of the shaft 19. It should be appreciated that the grooves 76 and 77 may both be of the same size. The bosses 79 will be sized accordingly.

Figure 4:
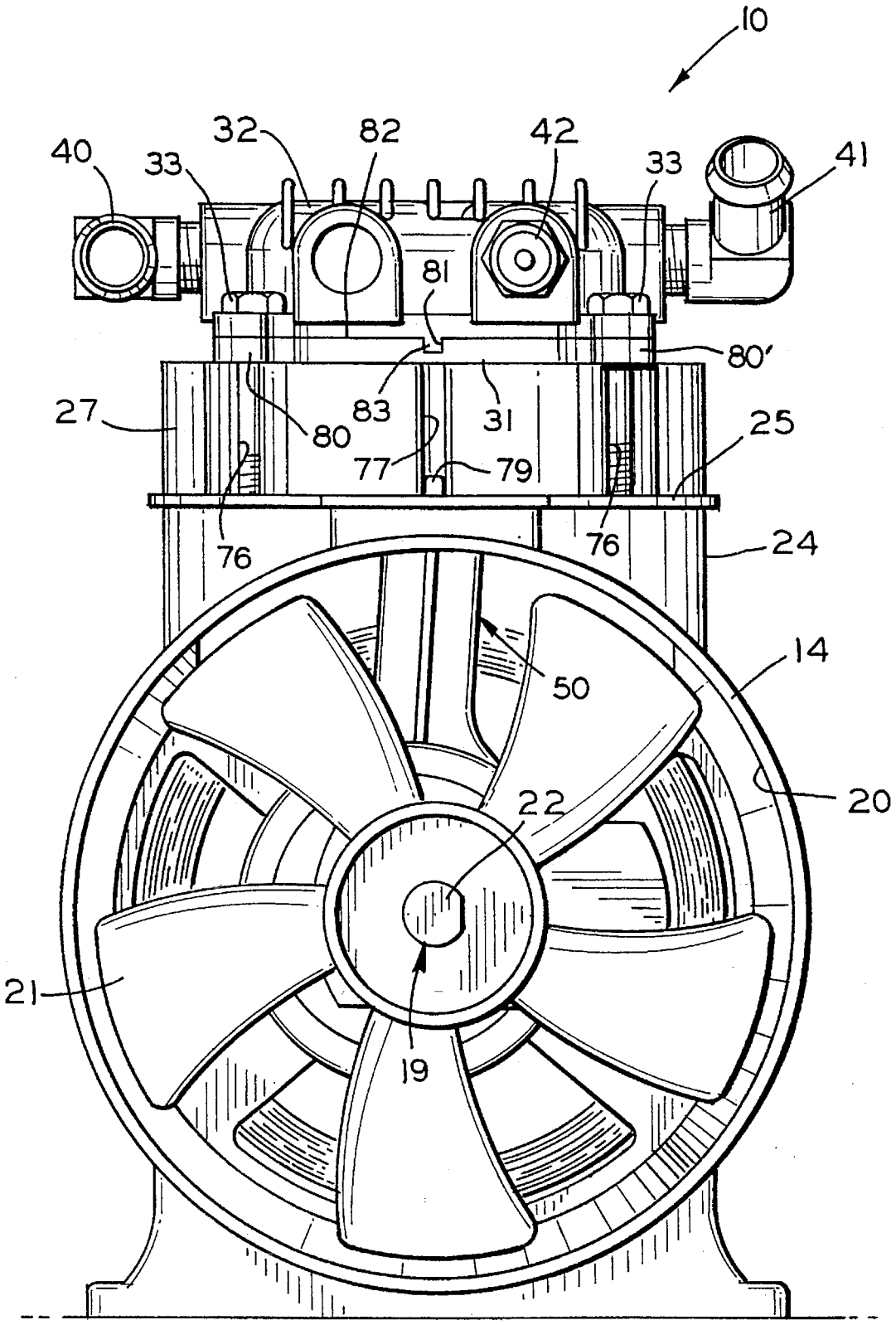
FIG. 4 is an end view of the air compressor of FIG. 1.

Referring now to FIG. 4, the valve plate 31 has tabs 80 through which the bolts 33 extend. At least one of the tabs 80' extends slightly into one of wider cylinder sleeve grooves 76 to orient the valve plate 31 relative to the cylinder sleeve 27. This allows orienting the valve plate 31 in 90° increments on the cylinder sleeve 27. Preferably, the valve plate 31 is provided with at least one notch 81 and preferably with two diametrically opposing notches 81 (only one illustrated) adjacent the perimeter of an upper surface 82. The cylinder head 32 is provided with a complementary boss 83 for engaging each notches 81 to orient the cylinder head 32 on the valve plate 31. When two notches 81 are provided, they are preferably of different sizes and the bosses 83 are sized accordingly so that the cylinder head 32 will fit in only one position on the valve plate 31. This assures that the compressor 10 cannot be incorrectly assembled. The inlet valves in the valve plate 31 can be aligned only with the inlet air chamber in the valve head 32 and the outlet valves in the valve plate 31 can be aligned only with the compressed air outlet chamber in the cylinder head 32. The valve plate 28 and the cylinder head 29 mounted on the cylinder sleeve 26 are similarly constructed.

As best shown in FIGS. 3, 4, 5 and 7, the arcuate outer walls 74 on the cylinder sleeve 26 are of a sufficiently large diameter to engage and be supported on the annular upper edge 25 of the housing 13. The passages 73 extend inwardly from the upper housing edge 25 and connect with the hollow housing interior 20. Except for adjacent the bolts 30, the valve plate 31 and the cylinder head 32 are of a sufficiently small diameter to only engage the inner wall 72 on the cylinder sleeve 26. Consequently, the passages 73 are vented to the atmosphere adjacent the valve plate 31. During operation of the compressor 10, the fan 21 increases the air pressure in the interior of the housing 20. As indicated above, the increased air pressure causes a flow of air through the vent slots 18 to cool the stator winding 17. Air flow also is induced through the passages 73 to cool the cylinder sleeve 26 and the attached valve plate 28 and cylinder head 29. Further, the air flow in the housing interior 20 will cool the piston assembly 50. Thus, the flow of cooling air reduces the operating temperature of the piston seal 56 to extend the operating life of the seal 56. The cylinder 27 and its piston (not shown) are cooled in a similar manner.

It will be appreciated that various modifications and changes may be made to the above described preferred embodiment of an air compressor without departing from the spirit and the scope of the following claims.

We claim:

1. An air compressor comprising a hollow cylindrical housing having an open first end and a second end enclosing at least a portion of an electric motor, said motor having a rotatable shaft extending in said housing, a plurality of vent slots spaced around said housing adjacent said second end, a fan mounted on said shaft adjacent said first housing end, said fan causing air to flow into said first housing end and to flow from said slots when said motor shaft is rotated, said housing having an opening extending perpendicular to said shaft, said opening having a perimeter, a cylinder sleeve having first and second axially spaced ends, a cylindrical central passage defining an inner perimeter, an outer perimeter spaced from said inner perimeter and a plurality of spaced axially directed cooling air passages located in said cylinder sleeve between said inner and outer perimeters, said outer cylinder sleeve perimeter at said first end abutting said housing opening perimeter whereby said cooling air passages open into said housing to receive a flow of air from said fan when said motor shaft is rotated, a valve plate having a first side sealed to said inner perimeter of said cylinder sleeve at said second cylinder sleeve end and a second side sealed to a cylinder head, said cylinder head having an air inlet chamber and a compressed air outlet chamber, an inlet valve on said valve plate adapted to allow air to flow from said inlet chamber to said central passage in said cylinder sleeve, an outlet valve on said valve plate adapted to allow air to flow from said central passage in said cylinder sleeve to said outlet chamber, and a piston having a head located to reciprocate in said central cylinder sleeve passage and having a connecting rod connected through an eccentric to said shaft.

2. An air compressor, as set forth in claim 1, and further including means for orienting said cylinder sleeve relative to said housing, means for orienting said valve plate relative to said cylinder sleeve, and means for orienting said cylinder head relative to said valve plate.

3. An air compressor, as set forth in claim 2, wherein said means for orienting said valve plate relative to said cylinder sleeve comprises at least one tab on said valve plate engaging an end of a longitudinal groove in said cylinder sleeve, and wherein said means for orienting said cylinder sleeve relative to said housing includes at least one boss on said housing engaging an end of a longitudinal groove in said cylinder sleeve.

4. An air compressor, as set forth in claim 2, and wherein said means for orienting said cylinder head relative to said valve plate includes a notch in said valve plate and a boss on said valve head located to engage said notch to align said outlet chamber in said valve head with said outlet valve on said valve plate.

5. An air compressor, as set forth in claim 4, wherein said means for orienting said valve plate relative to said cylinder sleeve comprises at least one tab on said valve plate engaging an end of a longitudinal groove in said cylinder sleeve, and wherein said means for orienting said cylinder sleeve relative to said housing includes at least on boss on said housing engaging an end of a longitudinal groove in said cylinder sleeve.

6. An air compressor, as set forth in claim 1, wherein said cylinder sleeve is an extrusion having a length slightly less than a predetermined length, and further including a shim having a thickness equal to the difference between said cylinder sleeve length and said predetermined length, and wherein said shim is positioned between said outer perimeter at said first end of said cylinder sleeve and said housing opening perimeter.

* * * * *